US007845282B2

(12) United States Patent
Sheridan et al.

(10) Patent No.: US 7,845,282 B2
(45) Date of Patent: Dec. 7, 2010

(54) SELECTABLE EFFECT WARHEAD

(75) Inventors: Edward W. Sheridan, Orlando, FL (US); George D. Hugus, Chuluota, FL (US); Joseph G. Metzger, Grapevine, TX (US)

(73) Assignee: Lockheed Martin Corporation, Bethesda, MD (US)

( * ) Notice: Subject to any disclaimer, the term of this patent is extended or adjusted under 35 U.S.C. 154(b) by 802 days.

(21) Appl. No.: 11/806,221

(22) Filed: May 30, 2007

(65) Prior Publication Data

US 2010/0282115 A1 Nov. 11, 2010

Related U.S. Application Data

(60) Provisional application No. 60/809,046, filed on May 30, 2006.

(51) Int. Cl.
*F42B 12/22* (2006.01)

(52) U.S. Cl. ..... 102/473; 102/491; 102/492; 102/497; 102/476; 102/475

(58) Field of Classification Search ..... 102/473, 102/491, 492, 497, 476, 475, 306
See application file for complete search history.

(56) References Cited

U.S. PATENT DOCUMENTS 3,961,576 A 6/1976 Montgomery, Jr.
4,112,847 A * 9/1978 Thomanek ..... 102/496
4,357,873 A * 11/1982 Jager ..... 102/310
4,982,667 A * 1/1991 Weimann ..... 102/476
4,996,922 A 3/1991 Halcomb et al.
5,243,916 A * 9/1993 Freche et al. ..... 102/481
5,509,357 A 4/1996 Lawther
5,544,589 A 8/1996 Held
5,700,974 A 12/1997 Taylor
5,817,970 A * 10/1998 Feierlein ..... 102/502

(Continued)

OTHER PUBLICATIONS

Hugus et al., U.S. Appl. No. 11/447,068, filed Jun. 6, 2006, entitled "Metal Matrix Composite Energetic Structures".

*Primary Examiner*—Michelle Clement
(74) *Attorney, Agent, or Firm*—Buchanan Ingersoll & Rooney PC

(57) ABSTRACT

A munition includes a casing, the casing formed at least in part from a material comprising (i) a meltable or phase-changing material, and (ii) an energetic material; an explosive payload contained within the casing; and a fuze arrangement, the fuze arrangement comprising a main fuze configured and arranged to ignite the high explosive, and at least one secondary fuze configured and arranged to cause the casing material to melt or undergo a phase change. A method of selectively altering the mode of operation of a munition includes: forming a casing, the casing comprising a material comprising (i) a meltable or phase-changing material, and (ii) an energetic material; introducing an explosive payload into the casing; providing a fuze arrangement comprising a main fuse and at least one secondary fuze configured and arranged to cause the casing material to melt or undergo a phase change; and selectively activating the main fuze and the at least one secondary fuze in a manner that provided at least a first and a second mode of operation, the first mode of operation comprising blast coupled with fragmentation effects, and the second mode of operation comprising mainly blast effects.

10 Claims, 2 Drawing Sheets

U.S. PATENT DOCUMENTS 5,852,256 A * 12/1998 Hornig ..... 102/473
5,859,383 A * 1/1999 Davison et al. ..... 102/307
5,912,069 A 6/1999 Yializis et al.
5,936,184 A 8/1999 Majerus et al.
5,939,662 A * 8/1999 Bootes et al. ..... 102/473
5,949,016 A * 9/1999 Baroody et al. ..... 149/18
6,220,166 B1 * 4/2001 Cherry ..... 102/305
6,276,277 B1 8/2001 Schmacker
6,308,607 B1 * 10/2001 Woodall et al. ..... 89/1.13
6,321,656 B1 * 11/2001 Johnson ..... 102/377
6,464,019 B1 * 10/2002 Werner et al. ..... 175/4.6
6,467,416 B1 * 10/2002 Daniels et al. ..... 102/476
6,494,140 B1 12/2002 Webster
6,520,258 B1 * 2/2003 Yang et al. ..... 166/297
6,615,737 B2 * 9/2003 Bonnel et al. ..... 102/481
6,627,013 B2 9/2003 Carter, Jr. et al.
6,666,143 B1 * 12/2003 Collins ..... 102/334
6,668,726 B2 * 12/2003 Lussier ..... 102/307
6,679,960 B2 1/2004 Jones
7,231,876 B2 * 6/2007 Kellner ..... 102/517
7,282,634 B2 * 10/2007 Kuklinski ..... 114/20.1
7,513,198 B2 * 4/2009 Zhang et al. ..... 102/475
7,658,150 B2 * 2/2010 Ronn et al. ..... 102/476
7,743,707 B1 * 6/2010 Melin et al. ..... 102/493
2003/0010246 A1 * 1/2003 Bonnel et al. ..... 102/481
2003/0037692 A1 2/2003 Liu
2003/0131749 A1 * 7/2003 Lussier ..... 102/306
2003/0167956 A1 * 9/2003 Kellner ..... 102/517
2005/0235862 A1 10/2005 Gousman et al.
2007/0006766 A1 * 1/2007 Kellner ..... 102/475
2008/0092764 A1 * 4/2008 Renaud-Bezot et al. .. 102/202.9
2009/0078146 A1 * 3/2009 Tepera et al. ..... 102/473
2009/0235836 A1 * 9/2009 Pratt et al. ..... 102/306
2009/0255433 A1 * 10/2009 Wang et al. ..... 102/307

* cited by examiner

SELECTABLE EFFECT WARHEAD

This application claims priority, pursuant to 35 U.S.C. §119, to U.S. Provisional Patent Application No. 60/809,046 filed May 30, 2006, the entire content of which is incorporated herein by reference.

FIELD OF THE DISCLOSURE

The present disclosure relates to arrangements, compositions, as well as design and fabrication techniques relating to munitions.

BACKGROUND OF THE INVENTION

In the discussion of the state of the art that follows, reference is made to certain structures and/or methods. However, the following references should not be construed as an admission that these structures and/or methods constitute prior art. Applicant expressly reserves the right to demonstrate that such structures and/or methods do not qualify as prior art.

A conventional blast-frag warhead inflicts damage by two primary methods. The first is the overpressure generated from the detonation of an explosive fill. The second is the formation and acceleration of metal fragments from the warhead case caused by the detonation of an explosive. Different targets exhibit varying degrees of vulnerability to these damage mechanisms. Materiel is more vulnerable to fragments and structures are more vulnerable to blast overpressure. Personnel are vulnerable to both. In light of this, general purpose bombs are usually of the blast-frag variety to ensure that a large target set can be held at risk with a single weapon.

In general, the damage radius for fragmentation is considerably larger than that for blast. Blast damage drops off as a function of distance to the 3rd power. The addition of precision delivery with blast-frag warheads enables a significant weapon system lethality overmatch against many targets. This overmatch has driven our adversaries to attempt to seek cover in civilian populations where our rules of engagement limit our ability to engage them. The rules of engagement are driven by the political motivation to limit collateral damage. Collateral damage is the unintended damage or destruction of life or property near a target. Thus a general purpose warhead that could limit collateral damage without compromising probability of kill would be highly advantageous.

Others have tried to create low collateral damage warheads by eliminating fragment formation by replacing a metal case with a fiber reinforced plastic one. The elimination of the fragments results in a warhead with a primarily blast damage mechanism. However, the permanent elimination of fragments limits the target set against which the weapon is useful and in essence a niche weapon. It increases the logistic trail and mission loadout complexity.

SUMMARY OF THE INVENTION

The disclosed invention includes methods and constructions for selecting between a blast or blast-frag operational mode for a warhead. The selectability is achieved, at least in part, by using a meltable or phase-changeable material in the warhead case. For example, within the case, included as a composite structure or as a discreet layer(s), is a reactive material capable of releasing sufficient thermal energy to melt the meltable material of the case. The case is filled with an explosive payload.

In the blast-frag mode, the warhead is detonated as a conventional warhead, and the metal within the case is fragmented or dispersed naturally or along preformed scribes. In the blast-only mode, a fuze or other initiating component is used to ignite the reactive material in the case. The heat released from the reactive material induces a phase transformation (e.g., melting) of the fragments within the case. Immediately following this reaction the high explosive is initiated allowing the blast to propagate through the molten material.

According to the principles of the present invention, the above-described selectability of the mode of operation of a munition allows the weapon to be used against a broad target set like a general purpose bomb, but when the need arises for reduced collateral effects, the fragments can be selectively eliminated.

According to one aspect, the present invention provides a munition comprising: a casing, the casing comprising a material comprising (i) a meltable or phase-changing material, and (ii) an energetic material; an explosive payload contained within the casing; and a fuze arrangement, the fuze arrangement comprising a main fuze configured and arranged to ignite the high explosive, and at least one secondary fuze configured and arranged to initiate melting or a phase change of the casing material.

According to a further aspect, the present invention provides A method of selectively altering the mode of operation of a munition, the method comprising: forming a casing, the casing comprising a material comprising (i) a meltable or phase-changing, and (ii) an energetic material; introducing an explosive payload into the casing; providing a fuze arrangement comprising a main fuze and at least one secondary fuze configured and arranged to initiate melting or a phase change of the casing material; and selectively activating the main fuze and the at least one secondary fuze in a manner that provides at least a first and a second mode of operation, the first mode of operation comprising blast coupled with fragmentation effects, and the second mode of operation comprising mainly blast effects.

BRIEF DESCRIPTION OF THE DRAWING FIGURES

The following detailed description of preferred embodiments can be read in connection with the accompanying drawings in which like numerals designate like elements and in which.

DETAILED DESCRIPTION

Figure 1:
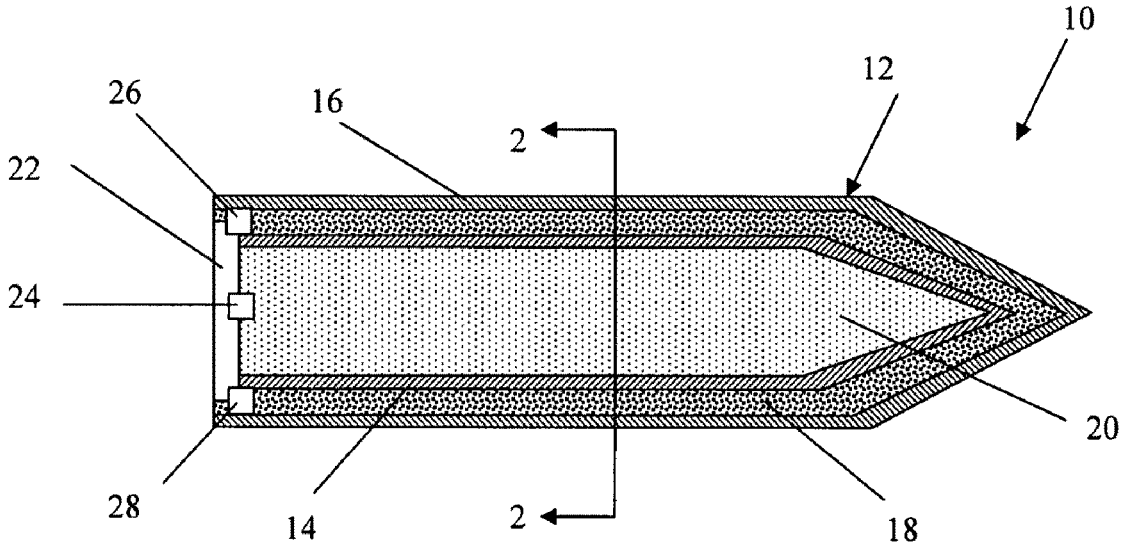
FIG. 1 is a longitudinal sectional illustration of a munition formed according to the principles of the present invention.
Figure 2:
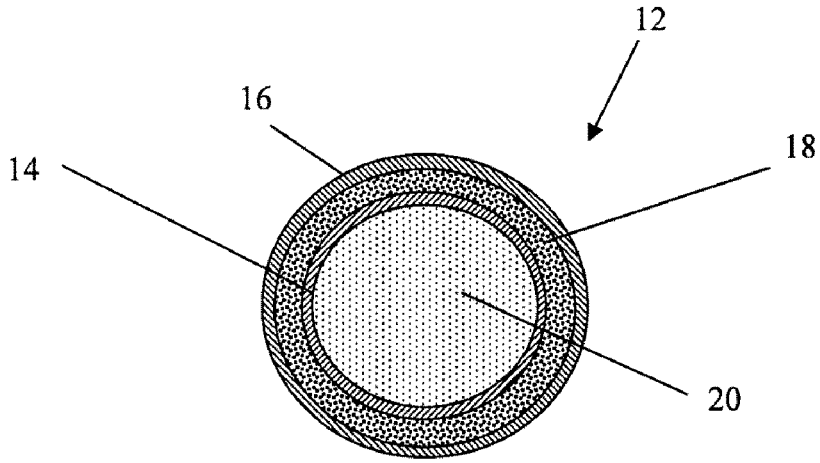
FIG. 2 is a cross-sectional view taken along line 2-2 of FIG. 1.

FIGS. 1-2 illustrates an exemplary munition 10 formed according to one embodiment of the present invention. As illustrated, the munition 10 may be in form of a warhead comprising a casing 12 carrying an explosive payload 20. The shape of the casing 12 is not limited to the illustrated embodiment, and may have any suitable geometry and/or size. The casing 12 may optionally include an inner and/or outer liner or shield 14 and/or 16, respectively. The liner(s) or shield(s) may be provided as a thermal shield. The liner(s) and/or shield(s) can be formed from any suitable material(s). By way of non-limiting example, the shields can be formed from a thermoplastic. Thermoplastics such as polytetrafluoroethylene (PTFE) or polyetheretherketone (PEEK) can be utilized. The linear(s) and/or shield(s) 14, 16 serve to, at least in part, prevent the transfer of thermal energy to the payload 20 of a magnitude that could cause unwanted detonation thereof.

The main component of the casing 12 is a layered or composite material 18. This material can be composed mainly of two components: (i) a meltable or phase-changing material, and (ii) an energetic material. The two components can be arranged relative to one another in any suitable fashion. For example, the material can comprise a matrix of the meltable or phase-changing material with the energetic material dispersed therein. Alternatively, the material can comprise one or more layers of the meltable or phase-changing and one or more layers of the energetic material.

The meltable or phase-changing material can be formed from any suitable metal or combination of metals and/or alloys. According to one embodiment, the metal comprises an elemental metal or alloy that when combined with the energetic component (or components); the pressure used to compact and densify the structure is of a magnitude below that which would cause auto ignition of the reactive materials. According to a further embodiment, the metal comprises one or more of: bismuth, lead, tin, aluminum, magnesium, titanium, gallium, indium, and alloys thereof. By way of non-limiting example, suitable alloys include (percentages are by mass): 52.2% In/45% Sn/1.8% Zn; 58% Bi/42% Sn; 60% Sn/40% Bi; 95% Bi/5% Sn; 55% Ge; 45% Al; 88.3% Al/11.7% Si; 92.5% Al/7.5% Si; 95% Al/15% Is; Zn 100%; 4% Al/2.5% Cu/0.04% Mg/Bal Zn; and 11% Al/1% Cu/0.025% Mg/Bal Zn. In addition, the metal may optionally include one or more reinforcing elements or additives. Thus, the metal may optionally include one or more of: an organic material, an inorganic material, a metastable intermolecular compound, and/or a hydride. By way of non-limiting example, one suitable additive could be a polymeric material that releases a gas upon thermal decomposition. The composite can also be reinforced by adding one or more of the following organic and/or inorganic reinforcements: continuous fibers, chopped fibers, whiskers, filaments, a structural preform, a woven fibrous material, a dispersed particulate, or a nonwoven fibrous material. The fragmenting composite may also be partially or full encapsulated within a metal jacket to provide strength and explosive launch survivability. Other suitable reinforcements are contemplated.

The energetic material component may comprise any suitable energetic material, which is dispersed within the meltable or phase-changing binder material, or disposed in one or more layer(s) adjacent to the meltable metal. The energetic material may have any suitable morphology (i.e., powder, flake, crystal, etc.) or composition.

The energetic material may comprise a material, or combination of materials, which upon reaction, release enthalpic or work-producing energy. One example of such a reaction is called a "thermite" reaction. Such reactions can be generally characterized as a reaction between a metal oxide and a reducing metal which upon reaction produces a metal, a different oxide, and energy. There are numerous possible metal oxide and reducing metals which can be utilized to form such reaction products. Suitable combinations include but are not limited to, mixtures of aluminum and copper oxide, aluminum and tungsten oxide, magnesium hydride and copper oxide, magnesium hydride and tungsten oxide, tantalum and copper oxide, titanium hydride and copper oxide, and thin films of aluminum and copper oxide. A generalized formula for the stoichiometry of this reaction can be represented as follows:

$$M_xO_y+M_Z=M_x+M_zO_y+\text{Energy}$$

wherein $M_xO_y$ is any of several possible metal oxides, $M_Z$ is any of several possible reducing metals, $M_x$ is the metal liberated from the original metal oxide, and $M_zO_y$ is a new metal oxide formed by the reaction. Thus, according to the principles of the present invention, the energetic material 130 may comprise any suitable combination of metal oxide and reducing metal which as described above. For purposes of illustration, suitable metal oxides include: $La_2O_3$, AgO, $ThO_2$, SrO, $ZrO_2$, $UO_2$, BaO, $CeO_2$, $B_2O_3$, $SiO_2$, $V_2O_5$, $Ta_2O_5$, NiO, $Ni_2O_3$, $Cr_2O_3$, $MoO_3$, $P_2O_5$, $SnO_2$, $WO_2$, $WO_3$, $Fe_3O_4$, $MoO_3$, NiO, CoO, $Co_3O_4$, $Sb_2O_3$, PbO, $Fe_2O_3$, $Bi_2O_3$, $MnO_2$ $Cu_2O$, and CuO. For purposes of illustration, suitable reducing metals include: Al, Zr, Zn, Th, Ca, Mg, U, B, Ce, Be, Ti, Ta, Hf, and La. The reducing metal may also be in the form of an alloy or intermetallic compound of the above. For purposes of illustration, the metal oxide is an oxide of a transition metal. According to another example, the metal oxide is a copper or tungsten oxide. According to another alternative example, the reducing metal comprises aluminum or an aluminum-containing compound.

As noted above, the energetic material component may have any suitable morphology. Thus, the energetic material may comprise a mixture of fine powders of one or more of the above-mentioned metal oxides and one or more of the reducing metals. This mixture of powders may be dispersed in the metal, which can act like a binder. According to certain embodiments, the metal acts as a partial or complete source of metal fuel for the energetic, or thermite, reaction.

The energetic material may be in the form of a thin film having at least one layer of any of the aforementioned reducing metals and at least one layer of any of the aforementioned metal oxides. The thickness of the alternating layers can vary, and can be selected to impart desirable properties to the energetic material. For purposes of illustration, the thickness of layers and can be about 10 to about 1000 nm. The layers may be formed by any suitable technique, such as chemical or physical deposition, vacuum deposition, sputtering (e.g., magnetron sputtering), or any other suitable thin film deposition technique. Each layer of reducing metal present in the thin-film can be formed from the same metal. Alternatively, the various layers of reducing metal can be composed of different metals, thereby producing a multilayer structure having a plurality of different reducing metals contained therein. Similarly, each layer of metal oxide can be formed from the same metal oxide. Alternatively, the various layers of metal oxide can be composed of different oxides, thereby producing a multilayer structure having different metal oxides contained therein. The ability to vary the composition of the reducing metals and/or metal oxides contained in the thin-film structure advantageously increases the ability to tailor the properties of the detonable energetic material, and thus the properties of the casing material.

The casing 12 of the present invention can be formed according to any suitable method or technique.

Generally speaking, a suitable method for forming a casing according to the present invention includes forming an energetic material, combining the energetic material with a meltable or phase-changing material to form a mixture, and shaping the mixture to form a composite structural component (e.g., casing).

The energetic material can be formed according to any suitable method or technique. For example, when the energetic material is in the form of a thin film, as mentioned above, the thin-film detonable energetic material can be formed as follows. The alternating layers of oxide and reducing metal are deposited on a substrate using a suitable technique, such as vacuum vapor deposition or magnetron sputtering. Other techniques include mechanical rolling and ball milling to produce layered structures that are structurally similar to those produce in vacuum deposition. The deposition or fabrication processes are controlled to provide the desired layer thickness, typically on the order of about 10 to about 1000 nm. The thin-film comprising the above-mentioned alternating layers is then removed form the substrate. Removable can be accomplished by a number of suitable techniques such as photoresist coated substrate lift-off, preferential dissolution of coated substrates, and thermal stock of coating and substrate to cause film delamination. According to one embodiment, the inherent strain at the interface between the substrate and the deposited thin film is such that the thin-film will flake off the substrate with minimal or no effort.

The removed layered material is then reduced in size; preferably, in a manner such that the pieces of thin-film having a reduced size are also substantially uniform. A number of suitable techniques can be utilized to accomplish this. For example, the pieces of thin-film removed from a substrate can be worked to pass them through a screen having a desired mesh size. By way of non-limiting example, a 25-60 size mesh screen can be utilized for this purpose. This accomplishes both objectives of reducing the size of the pieces of thin-film removed from the substrate, and rendering the size of these pieces substantially uniform.

The above-mentioned reduced-size pieces of thin layered film are then combined with metallic matrix or binder material to form a mixture. The metallic binder material can be selected from many of the above-mentioned binder materials. This combination can be accomplished by any suitable technique, such as milling or blending. Additives or additional components can be added to the mixture. As noted above, such additives or additional components may comprise one or more of: an organic material, and inorganic material, a metastable intermolecular compound, and/or a hydride. In addition, one or more reinforcements may also be added. Such reinforcements may include organic and/or inorganic materials in the form of one or more of: continuous fibers, chopped fibers, whiskers, filaments, a structural preform, dispersed particulate, a woven fibrous material, or a nonwoven fibrous material. Optionally, the pieces of layered film, the metallic binder material, the above-mentioned additives and/or the above-mentioned reinforcements can be treated in a manner that functionalizes the surface(s) thereof, thereby promoting wetting of the pieces of thin-film in the matrix of metallic binder. Such treatments are per se known in the art. For example, the particles can be coated with a material that imparts a favorable surface energy thereto.

This mixture can then be shaped thereby forming a structural component having a desired geometrical configuration. The structural component can be shaped by any suitable technique, such as molding or casting, pressing, forging, cold isostatic pressing, hot isostatic pressing. As noted above, the structural component or casing can be provided with any suitable geometry.

As explained above, there are number of potential applications for a structural component according to principles of the present invention. Non-limiting exemplary weapons and/or weapons systems which may incorporate composite structural components formed according to the principles of the present invention include a BLU-109 warhead or other munition such as BLU-109/B, BLU-113, BLU-116, JASSM-1000, J-1000, and the JAST-1000.

Figure 3:
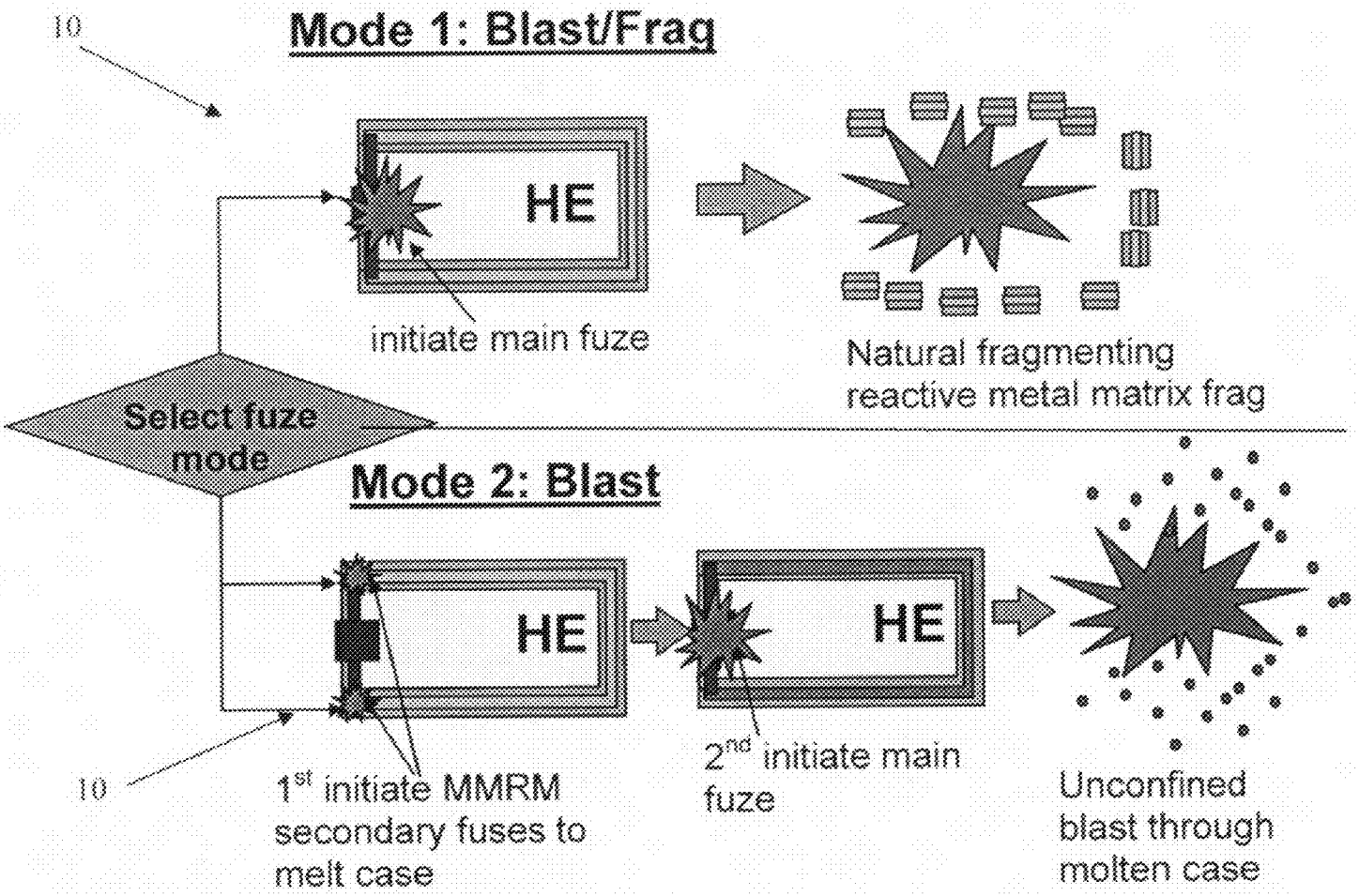
FIG. 3 is a schematic illustration of different modes of operation of a munition according to the principles of the present invention.

As previously noted, one of the advantages of a munition constructed according to the principles of the present invention is that a single weapon can be provided that has a mode of operation that can be selectively changed. Two such selectable alternative modes of operation are illustrated in FIG. 3. The munition 10 is only schematically illustrated in FIG. 3, and may take any suitable form. The munition 10 may comprise a casing (e.g., element 12; FIGS. 1-2) formed at least in part from a meltable or phase-changing energetic material combination as described above (e.g., element 18; FIGS. 1-2). The munition may also be provided with an inner and/or outer layer or shield, such as heat shields and to provide containment of melted metal in a blast-only mode (e.g., 14, 16; FIGS. 1-2). The behavior of the munition 10 is controlled mainly through the selection and operation of the fuze arrangement (e.g., elements 22, 24, 26 and 28; FIGS. 1-2).

As illustrated in FIG. 3, the mode of operation of the fuze arrangement is selected. According to a first mode, the main fuze is activated which ignites the high explosive contained within the munition. This explosion causes the casing of the munition to fragment along natural or pre-scribed fault lines. The fragments are intended to impact the target. The kinetic energy of the fragments imparts a destructive effect to the target upon impact therewith.

According to a second mode, one or more secondary fuzes are activated, causing the metal of the casing to undergo a phase change (e.g., melt). Subsequently, or simultaneously, the main fuze is activated causing ignition of the high explosive, thereby causing an explosion. However, since the casing has been reduced to a non-solid state, no (or few) solid fragments are produced thereby. Thus, the amount of collateral damage produced by the spreading of and impact of fragments can be greatly reduced, if not eliminated.

All numbers expressing quantities of ingredients, constituents, reaction conditions, and so forth used in the specification are to be understood as being modified in all instances by the term "about". Notwithstanding that the numerical ranges and parameters setting forth, the broad scope of the subject matter presented herein are approximations, the numerical values set forth are indicated as precisely as possible. Any numerical value, however, inherently contains certain errors necessarily resulting from their respective measurement techniques, as evidenced for example, by the standard deviation associated therewith.

Although the present invention has been described in connection with preferred embodiments thereof, it will be appreciated by those skilled in the art that additions, deletions, modifications, and substitutions not specifically described may be made without department from the spirit and scope of the invention as defined in the appended claims.

We claim:

1. A munition comprising:

a casing, the casing comprising a material comprising (i) a meltable or phase-changing material, and (ii) an energetic material;

an explosive payload contained within the casing; and a fuze arrangement, the fuze arrangement comprising a main fuse configured and arranged to ignite the high explosive, and at least one secondary fuze configured and arranged to initiate melting or a phase change of the casing material.

2. The munition of claim 1, wherein the munition comprises a warhead.

3. The munition of claim 1, wherein the meltable or phase-changing material comprises a metal such as one or more of bismuth, lead, tin, indium, zinc, and alloys thereof.

4. The munition of claim 1, wherein the energetic material is flaked, powdered, or crystallized.

5. The munition of claim 1, wherein the energetic material comprises a thin layered structure, the thin layered structure comprises at least one layer comprising a reducing metal or metal hydride and at least one layer comprising a metal oxide.

6. The munition of claim 5, wherein the layers have a thickness of about 10 to about 10000 nm.

7. The munition of claim 1, wherein the casing material comprises a matrix of metal with the energetic material dispersed therein.

8. The munition of claim 1, wherein the casing material comprises at least one layer formed from metal and at least one layer formed from the energetic material.

9. The munition of claim 8, wherein the layers are adjacent.

10. The munition of claim 9, wherein the layers are contiguous.

* * * * *